US010145166B2

(12) United States Patent
Berger et al.

(10) Patent No.: US 10,145,166 B2
(45) Date of Patent: Dec. 4, 2018

(54) CONNECTING DEVICE FOR A SLIDING DOOR

(71) Applicant: EKU AG, Sirnach (CH)

(72) Inventors: Patrick Berger, Bischofszell (CH); Heinz Schmidhauser, Zihlschlacht (CH)

(73) Assignee: EKU AG, Sirnach (CH)

( * ) Notice: Subject to any disclaimer, the term of this patent is extended or adjusted under 35 U.S.C. 154(b) by 202 days.

(21) Appl. No.: 15/138,395

(22) Filed: Apr. 26, 2016

(65) Prior Publication Data

US 2016/0312520 A1 Oct. 27, 2016

(30) Foreign Application Priority Data

Apr. 27, 2015 (EP) ..... 15165291

(51) Int. Cl.
*E06B 3/46* (2006.01)
*E05D 15/10* (2006.01)
(Continued)

(52) U.S. Cl.
CPC ..... *E06B 3/4663* (2013.01); *A47B 61/00* (2013.01); *E05D 15/10* (2013.01); *E05D 15/0665* (2013.01); *E05D 15/0669* (2013.01); *E05D 2015/1026* (2013.01); *E05D 2015/1031* (2013.01); *E05Y 2201/696* (2013.01);
(Continued)

(58) Field of Classification Search
CPC ..... E06B 3/4663; A47B 61/00; E05D 15/10; E05D 15/0665; E05D 15/0669; E05D 15/063; E05D 15/0634; E05D 2015/1026; E05D 2015/1031; E05Y 2201/696; E05Y 2201/64; E05Y 2600/10; E05Y 2600/312;
(Continued)

(56) References Cited

U.S. PATENT DOCUMENTS 1,105,918 A 8/1914 Plice
2,940,112 A * 6/1960 Riser ..... E05D 15/0634 16/105

(Continued)

FOREIGN PATENT DOCUMENTS

DE 466 175 C 10/1928
EP 2 778 332 A2 9/2014

OTHER PUBLICATIONS

Oct. 6, 2015 Search Report issued in European Patent Application No. 15165291.4.

*Primary Examiner* — William L Miller
(74) *Attorney, Agent, or Firm* — Oliff PLC

(57) ABSTRACT

The connecting device includes a mounting plate, which are connectable to a sliding door by means of mounting screws and which is connectable to a carriage device. A connecting plate is provided that is arranged between the mounting plate and a coupling plate, which is connectable to the carriage device. The connecting plate is connected, shiftable in a first direction, to the mounting plate by first connecting elements and is held shiftable to a selected first shift position by a first adjustment screw that is connected to the mounting plate. The coupling plate is connected, shiftable in a second direction, to the connecting plate by second connecting elements, and is held shiftable to a selected second shift position by a second adjustment screw that is connected to the connecting plate.

17 Claims, 8 Drawing Sheets

(51) Int. Cl.
*A47B 61/00* (2006.01)
*E05D 15/06* (2006.01)

(52) U.S. Cl.
CPC ..... *E05Y 2600/10* (2013.01); *E05Y 2600/312* (2013.01); *E05Y 2600/314* (2013.01); *E05Y 2600/322* (2013.01); *E05Y 2900/20* (2013.01); *Y10T 16/361* (2015.01)

(58) Field of Classification Search
CPC ..... E05Y 2600/314; E05Y 2600/322; E05Y 2900/20; Y10T 16/361; Y10T 16/3834
USPC ..... 16/90, 105; 312/109; 49/452, 409
See application file for complete search history.

(56) References Cited

U.S. PATENT DOCUMENTS

| | | | | |
|---|---|---|---|---|
| 6,698,138 | B1 | 3/2004 | Lin | |
| 7,770,329 | B2 * | 8/2010 | Hutnik | E05D 15/0669 49/410 |
| 8,381,354 | B2 | 2/2013 | Haab et al. | |
| 8,763,205 | B2 | 7/2014 | Schmidhauser et al. | |
| 9,163,445 | B2 * | 10/2015 | Andren | E05D 15/0634 |
| 9,458,654 | B2 * | 10/2016 | Palsson | E05D 15/0634 |
| 9,708,161 | B2 * | 7/2017 | Geroso | B66B 7/046 |
| 2013/0205542 | A1 * | 8/2013 | Backman | E05D 15/0634 16/102 |

* cited by examiner

CONNECTING DEVICE FOR A SLIDING DOOR

BACKGROUND

The invention relates to a connecting device for sliding doors, particularly for sliding doors of a piece of furniture that are held shiftable by a guiding device and to a piece of furniture, particularly a wardrobe, with at least one sliding door that is held by means of such a connecting device.

[1], U.S. Pat. No. 8,763,205B2, discloses a wardrobe with a plurality of sliding doors that are held and guided each by carriage devices that are held and guided along guide rails, so that the sliding doors can be offset from a wardrobe opening and moved laterally. The carriage devices comprise carriage arms that are connected via connecting devices to the sliding doors.

A disadvantage of wardrobes with sliding doors of this kind is that the sliding doors need to be aligned precisely, in order to avoid collisions when being shifted and to provide an advantageous appearance. Thereby, known connecting devices do not allow simple adjustment of the held sliding doors.

Often, options for adjusting a sliding door are provided within the carriage devices, as shown for example in [2], U.S. Pat. No. 8,381,354B2. This requires complex carriage devices, which accordingly are quite expensive.

Further known are adjustable devices with parts that are movable against one another, which often need to be released from one another, before adjustment is possible. Such devices typically comprise a complex design and are difficult to adjust, since after a mutual movement and subsequent mutual fixing of the device parts, additional adjustment is often required.

SUMMARY

The present invention is therefore based on the object of providing an improved connecting device as well as a piece of furniture, particularly a wardrobe, with at least one sliding door that is held by means of such an improved connecting device.

In particular a connecting device shall be created that allows adjusting a sliding door or generally a flat separation element held by the connecting device at least in height, lateral position and preferably also inclination.

The connecting device shall be simple in construction and shall require little space. Further, the connecting device shall easily be adjustable after its installation.

Thereby it shall be avoided that means for mutual fixing of adjustable device parts are required, which for adjustment of the connecting device need to be released first. More particularly, it shall be avoided that readjustment is required later on.

Hence, the sliding doors of a wardrobe that are held by means of one or two connecting devices, shall be adjustable such that they can be aligned flush with its edges and front surfaces and that they reach desired positions and mutual distances in their end positions.

This problem solved with a connecting device and a piece of furniture, particularly a wardrobe with such connecting devices that comprise the features of claim 1 or claim 14 respectively. Preferred embodiments of the invention are defined in further claims.

The connecting device, which comprises a mounting plate, is connectable to a sliding door with mounting screws and is connectable to a carriage device. The connecting device comprises further a connecting plate that is arranged between the mounting plate and a coupling plate, which is connectable to the carriage device. The connecting plate is connected, shiftable in a first direction, to the mounting plate by first connecting elements and is held shiftable to a selected first shift position by a first adjustment screw that is connected to the mounting plate. The coupling plate is connected, shiftable in a second direction, to the connecting plate by second connecting elements and is held shiftable to a selected second shift position by a second adjustment screw that is connected to the connecting plate.

The construction of the connecting device with three plates mounted upon one another, preferably without play, which provide numerous shifting options, requires little space only.

The connecting plate is connected by the first connecting elements to the mounting plate and is held shiftable relative to the mounting plate in a first direction, preferably horizontally.

The coupling plate is connected by the second connecting elements to the connecting plate and is held shiftable relative to the connecting plate in a second direction, preferably vertically.

The first and second connecting elements are for example connecting screws, rivets or flange elements that are held e.g. in longitudinal slots and engage in corresponding grooves or overlap corresponding flange elements. The mounting plate comprises at the upper side and the lower side each for example a holding groove in which the connecting plate is shiftable such that the borders of the connecting plate engage in the holding grooves. It is advantageous to use connecting screws or rivets, which traverse longitudinal slots in the connecting plate and engage in receiving openings, e.g. in threaded bores, in the mounting plate, or to use connecting screws or rivets, which traverse longitudinal slots in the coupling plate and engage in receiving openings, e.g. in threaded bores, in the connecting plate.

Preferably rivets made of brass are used that allow connecting without play on the one hand the mounting plate and the connecting plate and on the other hand the connecting plate and the coupling plate and still allow mutual movement of these plates. The mounting plate and/or the connecting plate and/or the coupling plate are preferably made of steel, sheet steel or made by zinc die-casting. Production by zinc die-casting allows mutually moving plates, which abut without play, without substantial force.

The first and second longitudinal slots are aligned according to the provided shift directions inclined or perpendicular to one another.

Connection of the mounting plate and the connecting plate with the first adjustment screw and connection of the coupling plate with the connecting plate with the second adjustment screw can be reached in several ways. Preferably, parts of the mounting plate, the connecting plate and the coupling plate are designed as flange elements, which are connected with one another in pairs by the first adjustment screw or by the second adjustment screw and are shiftable towards or away from one another.

These flange elements can advantageously be cut out partially from the mounting plate, the connecting plate or the coupling plate and bent e.g. by 90°, so that they are aligned in parallel to one another. Flange elements, which fully or partially support the load of the related sliding door, can be connected to stabilising elements, e.g. stabilising ribs.

The mounting plate preferably comprises a mounting flange preferably provided with a threaded bore. The connecting plate preferably comprises a first connecting flange that is preferably provided with a first holding element. Hence, the first adjustment screw can be inserted into the first holding element provided at the connecting flange and can be turned into the mounting flange. For this purpose, the first adjustment screw preferably comprises a collar below the screw head, so that the first holding element, which has for example the form of a fork, can enter between the screw head and the collar and can engage with the screw shaft. Hence, the first adjustment screw is held by the connecting flange rotatable but axially not shiftable.

The connecting plate preferably comprises a second connecting flange. The coupling plate preferably comprises a coupling flange, which is preferably provided with a second holding element. Hence, the second adjustment screw can be inserted into the second holding element at the coupling flange and can be turned into the second connecting flange. For this purpose, the second adjustment screw preferably comprises a collar below the screw head, so that the second holding element, which has for example the form of a fork, can enter between the screw head and the collar and can engage with the screw shaft. Hence, the second adjustment screw is held by the coupling flange rotatable but axially not shiftable.

With the first and the second adjustment screw the mounting plate can be shifted in a plane, by horizontal movement the mounting plate can be shifted relative to the connecting plate and by vertical movement the connecting plate can be shifted relative to the coupling plate, in order to align the sliding door accordingly.

In a preferred embodiment a third adjustment screw is provided, with which the mounting plate or a part thereof is turnable relative to the coupling plate or with which the coupling plate or a part thereof is turnable relative to the mounting plate. By turning the third adjustment screw the mounting plate and therefore the sliding door connected thereto can be inclined within a limited angle range relative to the coupling plate.

Hence, with the first, the second and the third adjustment screw two sliding doors can be aligned relative to one another in height, lateral position and inclination. All adjustments can conveniently be executed at the connecting device. In order to facilitate adjustments the second and the third adjustment screw are arranged on the same side of the connecting device. The connecting device is preferably arranged on the lower side of the sliding door such that the second and the third adjustment screw are easily accessible below the sliding door. Below the sliding door, offset to the rear, the second and the third adjustment screw are not visible by the user, but can conveniently be reached by the service personnel. Mounting a bezel at the side of the sliding door, where the connecting device is mounted, can be avoided.

In a preferred embodiment the third adjustment screw is held in a threaded bore of an adjustment flange that is provided at the mounting plate such that the third adjustment screw is turnable against a stop member, which is provided at the connecting plate or at the coupling plate.

The mounting plate, the connecting plate or the coupling plate preferably comprise an articulated joint, around which the mounting plate or the coupling plate or a part thereof is turnable when the third adjustment screw is actuated. The articulated joint is preferably a bendable joint that is adjoined by at least one cut. I.e., preferably a part of the mounting plate, of the connecting plate, or the coupling plate is dimensioned such that a bending zone is formed, which can be deformed by turning the third adjustment screw, so that a part of the mounting plate or the coupling plate is turnable to a desired extent.

The mounting plate, the connecting plate and/or the coupling plate are preferably symmetrically designed. The mounting plate and the connecting plate are provided preferably on both sides with corresponding flange elements, in which the first adjustment screw can be inserted. In this way the connecting device can be mounted at the left or right side or also in the middle of a sliding door and can be adjusted. The first adjustment screw is inserted into the connecting flange and the mounting flange, which are facing the adjoining edge of the sliding door, so that the first adjustment screw can easily be grasped and turned.

The mounting plate, the connecting plate and/or the coupling plate are preferably cut out or punched out of a metal plate and are provided with the required openings, slots and cuts, which allow bending of the flange element and inserting the connecting screws and mounting screws. In this way the mounting plate and the connecting plate can be manufactured in a simple manner. The coupling plate is preferably provided with said stabilising ribs, with which the coupling flange is stabilised, into which preferably the mounting screws, which are provided for connection to the carriage device, are also inserted.

BRIEF DESCRIPTION OF THE DRAWINGS

The invention is described below with reference to the drawings. Shown are:

FIG. 1*a* shows an inventive wardrobe 9 with two sliding doors 91, 92 that are held by connecting devices 10, 10' and a complementary guide 6. With each of the sliding doors 91, 92 a related wardrobe opening 90 can be closed. In FIG. 1*a*, the first sliding door 91 has been moved away and the related wardrobe opening 90 has thereby been opened. In order to allow lateral movement of the first sliding door 91 front of the second sliding door 92, two movement processes were performed.

Figure 1A:
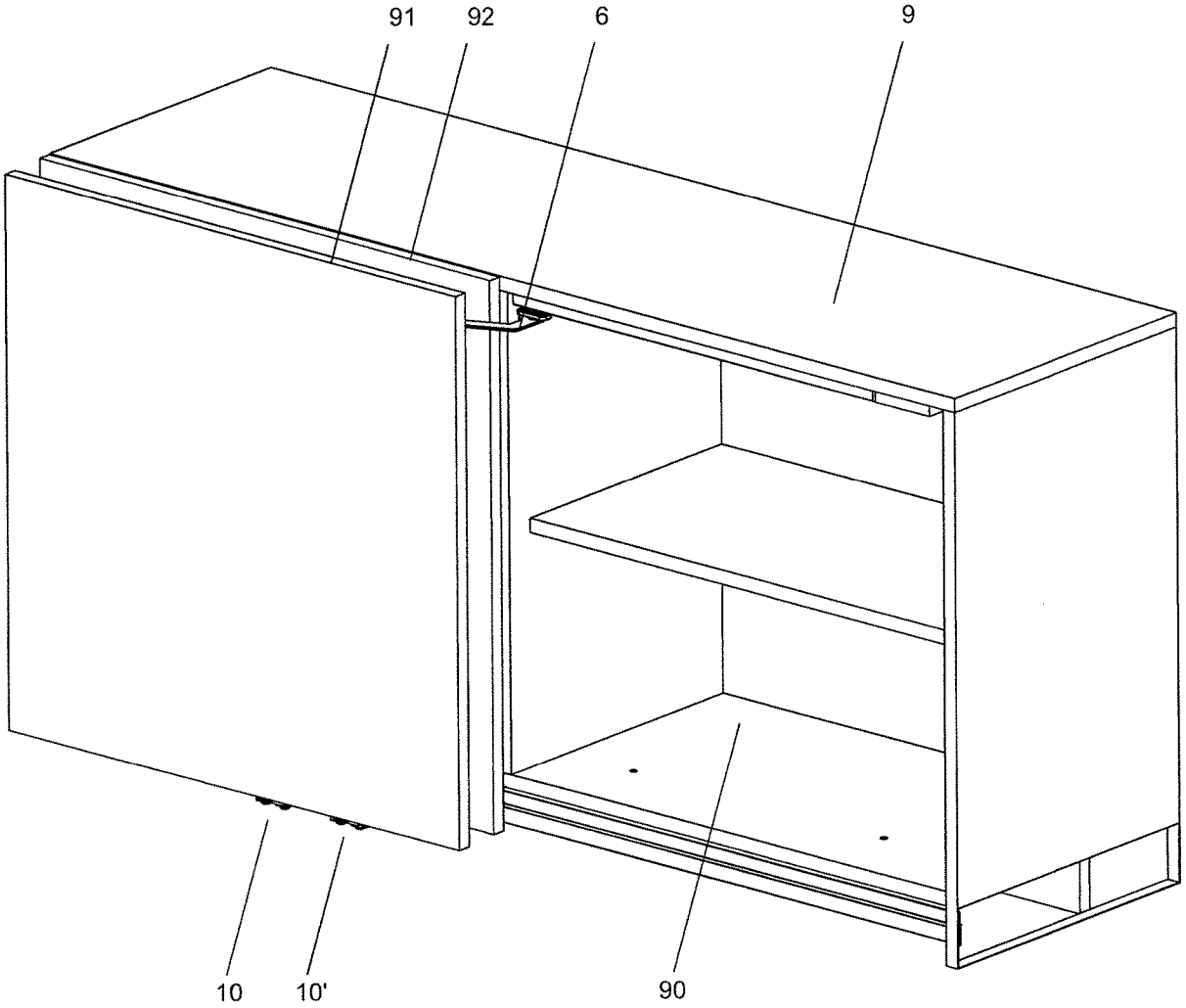
FIG. 1*a* an inventive wardrobe 9 with two sliding doors 91, 92, which are held by inventive connecting devices 10, 10' and a complementary guide 6 and which serve each for closing a wardrobe opening 90 and which can be offset from the wardrobe opening 90 and can laterally be moved.

In a first movement process the first sliding door 91 has been offset from the wardrobe opening 90 towards to front side and in a second movement process has been shifted laterally in front of the second sliding door 92. The guide rail, in which the carriage 8A (see FIG. 6*c*) that is connected to the first sliding door 91, is guided, therefore extends at first along a curve towards the front side and then in parallel to the front side of the wardrobe 9. After closing the first sliding door 91, the second sliding door 92 can be shifted in the same manner in front of the first sliding door 91. In the shown embodiment the carriages are arranged at the lower side of the wardrobe 9. At the upper side of the wardrobe 9 the sliding doors 91, 92 are held each by a complementary guide 9 and are guided in parallel to the lower side.

FIG. 1*a* shows that both sliding doors 91, 92, which are held in front of one another, are held precisely, i.e. aligned in parallel and flush with their edges. This not only allows perfect movement of both sliding doors 91, 92, but also provides an aesthetically advantageous appearance. Since slight deviations from ideal positions frequently occur, when the carriages, the guiding devices and the sliding doors 91, 92, are mounted in the wardrobe 9, it is necessary to perform corresponding adjustments of the sliding doors 91, 92. In order to avoid a requirement of access to the inside of the wardrobe 9, e.g. in order to adjust the carriage devices, the sliding doors 91, 92 are mounted with inventive connecting devices 10, 10', which allow executing all required adjustments.

Figure 1B:
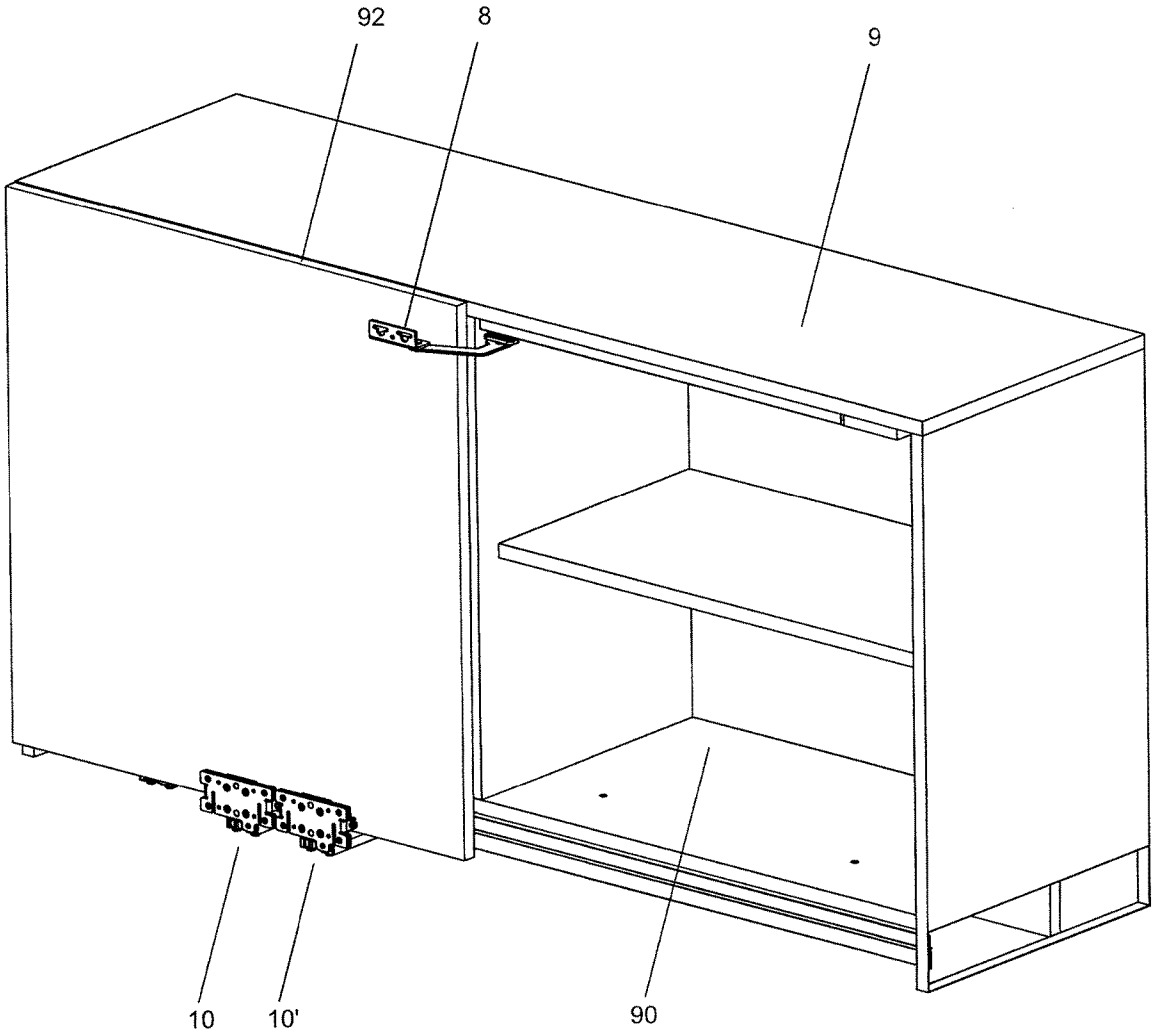
FIG. 1*b* the wardrobe 9 of FIG. 1*a* after releasing the first sliding door 91 from the related connecting devices 10, 10' and the complementary guide 6.

FIG. 1*b* shows the wardrobe 9 of FIG. 1*a* after the first sliding door 91 has been released from the related connecting devices 10, 10' and the complementary guide 6. It is shown that in the present embodiment of the wardrobe 9 two identical connecting devices 10, 10' are provided for mounting the sliding door 91. In the event that sliding doors with a reduced weight are used, then only one connecting device 10 can be used.

Figure 2:
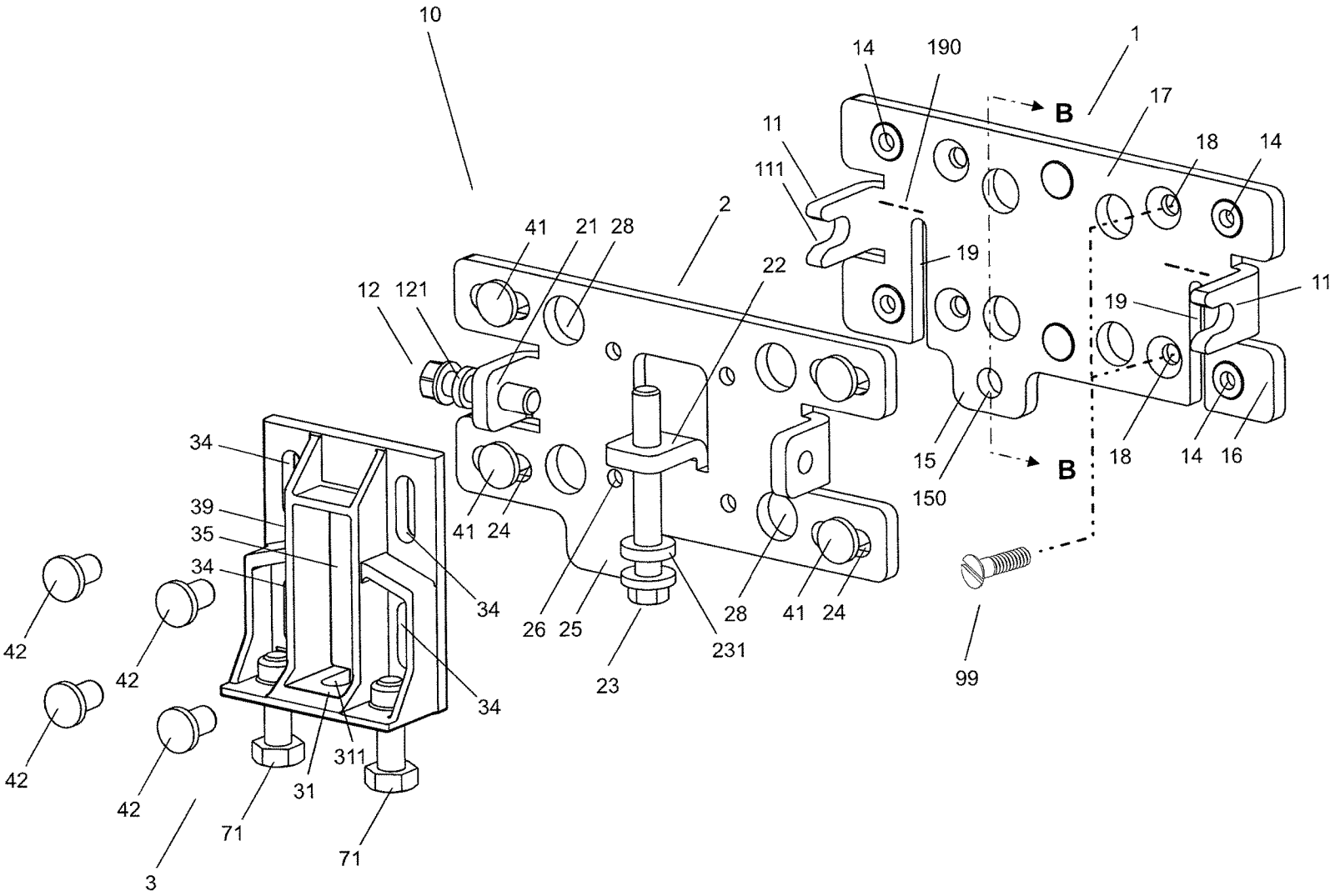
FIG. 2 one of the connecting devices 10 of FIG. 1*a* in explosion view with a mounting plate 1 that is connectable via a connecting plate 2 to a coupling plate 3.

FIG. 2 shows one of the connecting devices 10 of FIG. 1*a* in explosion view with a mounting plate 1 that is connectable via a connecting plate 2 to a coupling plate 3 and that comprises mounting bores 18, into which mounting screws 99 can be inserted, with which the connecting device 10 can be mounted at a sliding door 91. In order to maintain accessibility of the mounting bores 18 after the assembly of the connecting device 10, the connecting plate 2 comprises a related transfer openings 28 each having a size selected such that the mounting screws 99 are preferably still accessible after mutual displacement of the mounting plate 1 and the connecting plate 2. In order to avoid an obstacle that prevents displacement of the connecting plate 2, the heads of the mounting screws 99 are sunk into the mounting plate 1. For connecting the connecting device 10 to a carriage device the coupling plate 3 is provided with two coupling screws 71.

Figure 3:
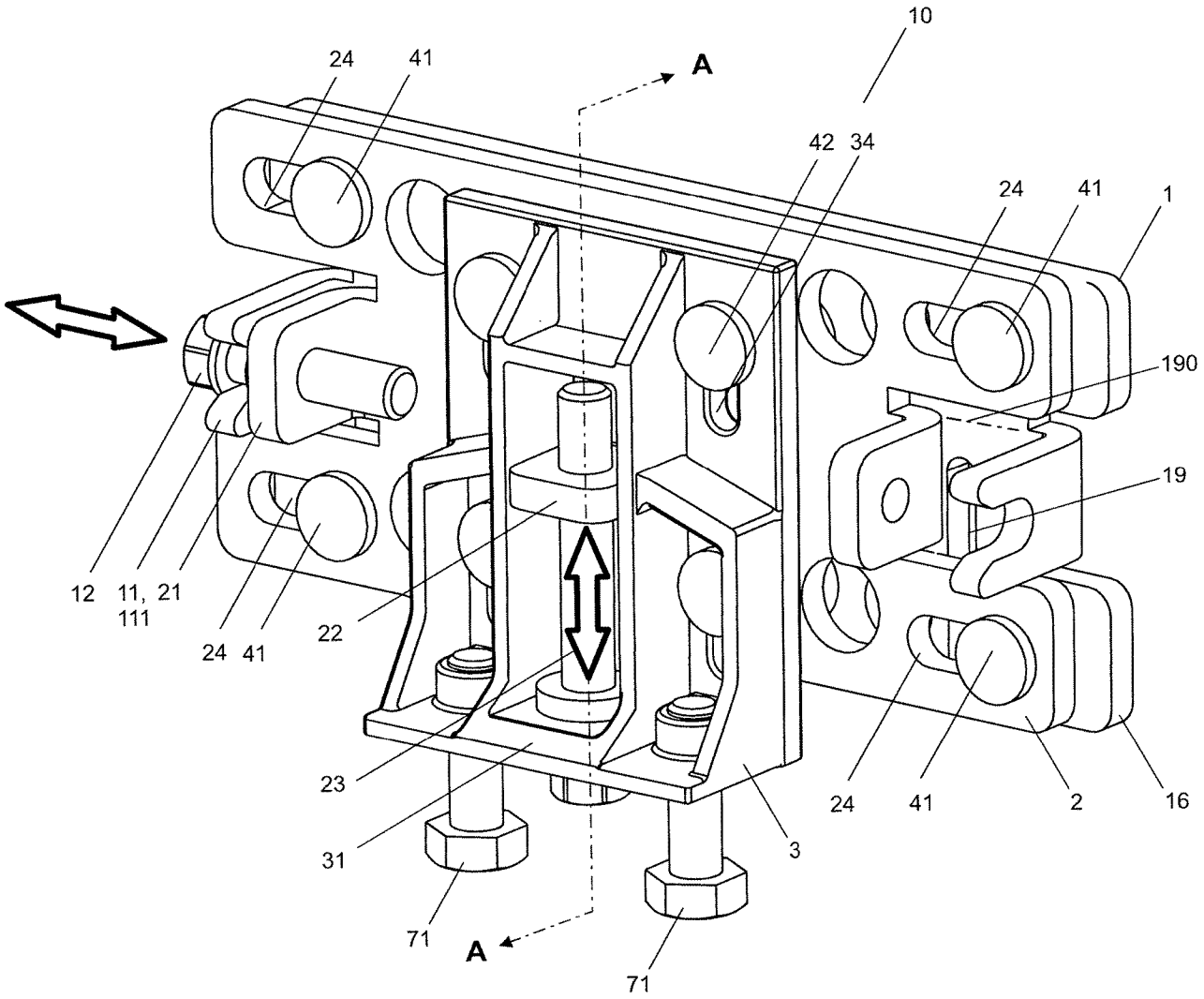
FIG. 3 the assembled connecting device 10 of FIG. 2 after a mutual horizontal displacement of the mounting plate 1 and the connecting plate 2 as well as a mutual vertical displacement of the coupling plate 3 and the connecting plate 2.

FIG. 3 shows the assembled connecting device 10 of FIG. 2 after mutual horizontal displacement of the mounting plate 1 and the connecting plate 2 as well as the mutual vertical displacement of the coupling plate 3 and the connecting plate 2.

The connecting device 10 is described below with reference to FIG. 2 and FIG. 3.

The at least approximately rectangular mounting plate 1 comprises in the four corner areas receiving openings, e.g. threaded bores 14, in which first connecting screws or rivets are inserted, which are extending through horizontally aligned longitudinal slots 24 provided in corner areas of the at least approximately rectangular connecting plate 2. Hence, with the first connecting screws 41 the mounting plate 1 and the connecting plate 2 are connected, shiftable against one another. The displacement range is thereby defined by the length of the longitudinal slots 24.

The mounting plate 1 comprises on both sides each a mounting flange 11, which has been cut out of the mounting plate 1 and has been bent by 90° against the connecting plate 2 and which comprises a fork-shaped holding element 111.

The connecting plate 2 comprises on both sides each a first connecting flange 21, which has been cut out of the connecting plate 2 and has been bent by 90° against the coupling plate 3 and which is provided with a threaded bore, in which a first adjustment screw 12 can be inserted. The first adjustment screw 12, which comprises a screw head and a collar 121 there below, is insertable into the fork-shaped holding element 111 of the corresponding mounting flange 11. Hence, the mounting plate 1 and the connecting plate 2, which are connected by the first connecting screws or rivets 41 shiftable against one another, can be shifted against or away from one another by turning the first adjustment screw 12 and remain fixed by the first adjustment screw 12 in a selected position.

Thereby, the first adjustment screw 12 can be connected on one side or the other side with the local mounting flange 11 and the first connecting flange 21. In the embodiment of FIG. 3 the first adjustment screw 12 can be removed from the left side and can be inserted on the right side, if the connecting device 10 is mounted at the right sided edge of the sliding door.

The connecting plate 2 comprises a second connecting flange 22 that has been cut out of the connecting plate 2 and has been bent by 90° against the coupling plate 3.

Further, the connecting plate 2 comprises four receiving openings, e.g. threaded bores 26, into which second connecting screws or rivets 42 are inserted, which are extending through vertically aligned longitudinal slots 34 provided in the connecting plate 2. With the second connecting screws or rivets 42 the connecting plate 2 and the coupling plate 3 are connected shiftable against one another. Thereby, the displacement range is defined by the length of the longitudinal slots 34.

Further, the coupling plate 3 comprises a coupling flange 31 with a second holding element 311, i.e. a U-shaped recess that is adjoined by a window opening 35 provided in the coupling plate 3. The window opening 35 serves for receiving the second connecting flange 22 which is aligned parallel to the coupling flange 31 and which is extending through the window opening 35 and is vertically shiftable therein. The coupling flange 31 serves further for holding the coupling screws 71.

In the holding element 311 of the coupling flange 31 a second adjustment screw 23 is mounted that comprises a screw head and a collar 231 below. The shaft of the second adjustment screw 23 is however held rotatable in a threaded bore provided in the second connecting flange 22. Hence, the coupling plate 3 and the connecting plate 2, which are connected by the second connecting screws or rivets 42 shiftable against one another, can be shifted against or away from one another by turning the second adjustment screw 23 and remain fixed by the second adjustment screw 23 in a selected position.

Hence, by the first and the second adjustment screw 12, 23 the mounting plate 1 and the coupling plate 3 can be shifted horizontally and vertically relative to one another into desired positions.

Furthermore, the inclination of the coupling plate 3 can be adjusted relative to the mounting plate 1. For this purpose the mounting plate 1 comprises 2 two articulated joints 190 in the embodiment of bendable joints which pivotally connect the body 17 of the mounting plate 1 with a wing element 16 each of the mounting plate 1. Both wing elements 16 are constituted by the two lower corners of the mounting plate 1, which are separated each by a cut 19 from the body 17 of the mounting plate 1. Hence, both wing elements 16 are connected by joints or bendable zones 190 to the body 17 of the mounting plate 1, so that the wing elements 16 can be bent by the application of force, i.e. by turning the third adjustment screw 13 (see FIG. 5*b*).

For holding the third adjustment screw 13 the mounting plate of FIG. 2 comprises on the lower side an adjustment flange 15 that is provided with a threaded bore 150. The third adjustment screw 13 held in the threaded bore 150 is turnable against a stop member 25 provided at the connecting plate 2. Hence, by turning the third adjustment screw 13 the lower side of the connecting plate 2 is pushed forward together with the coupling plate 3. By this process the wing elements 16 are turned together with the connecting plate 2 around the articulated joints 190. This simple mechanism and the simple design of the articulated joints 190 allow turning the mounting plate 1 and the coupling plate 3 against one another by a required angle and fixing them in a desired position. For this purpose, the mounting plate 1 is provided with the required elasticity so that the wing elements 16 act with a counterforce on the third adjustment screw 13, which always abut the stop member 25 without play.

FIG. 3 shows the assembled connecting device 10 after adjusting the first adjustment screw 12 and the second adjustment screw 23. By turning the first adjustment screw 12 the connecting plate 2 and the coupling plate 3 have been shifted relative to mounting plate 1 to the left side. By turning the second adjustment screw 23 the coupling plate 3 has been shifted downwards relative to the mounting plate 1 and to the connecting plate.

Figure 4B:
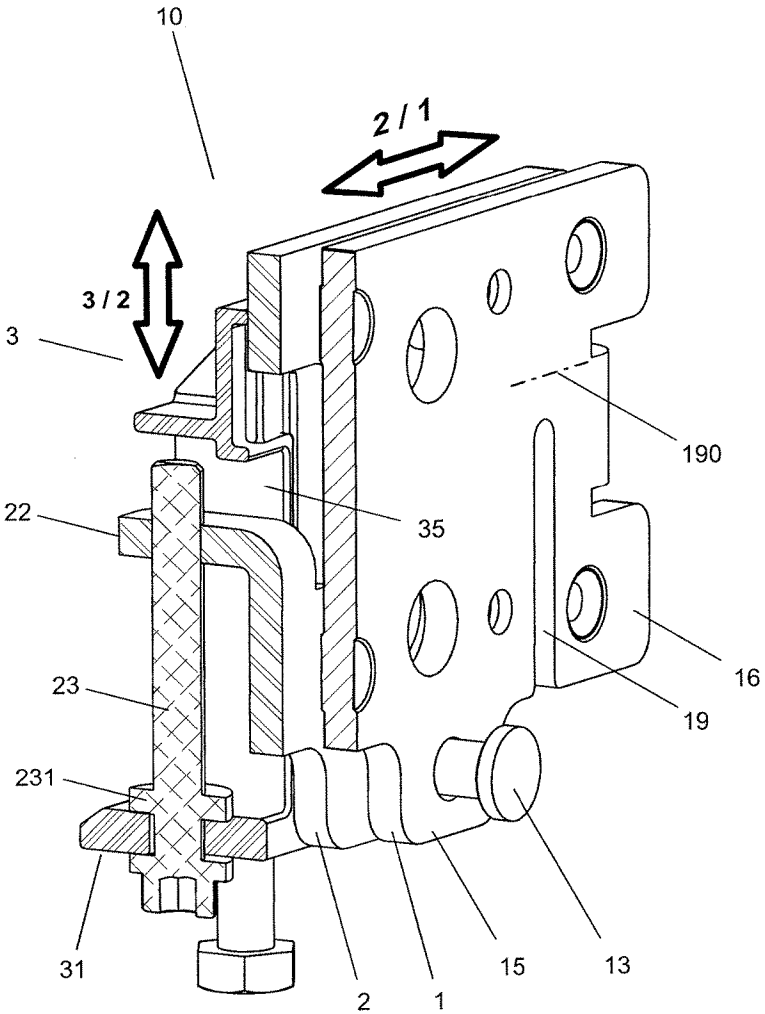
FIG. 4*b* a cut through the connecting device 10 of FIG. 3 along line A-A with subsequent mutual displacement of the mounting plate 1, the connecting plate 2 and the coupling plate 3.
Figure 4A:
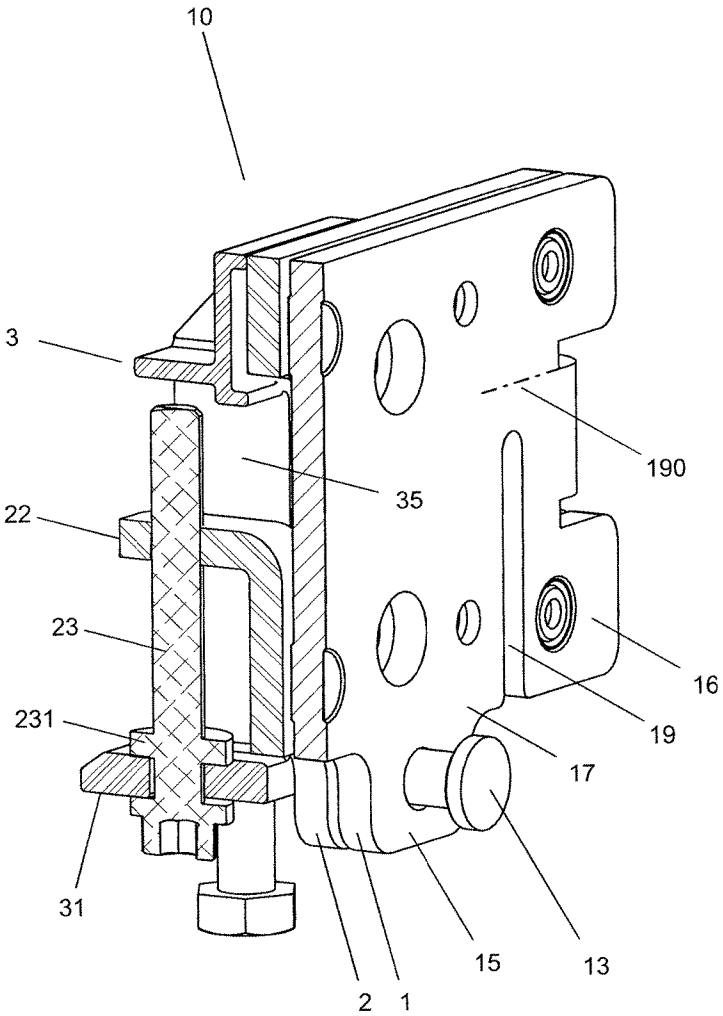
FIG. 4*a* a cut through the connecting device 10 of FIG. 3 along line A-A before the mutual displacement of the mounting plate 1, the connecting plate 2 and the coupling plate 3.

FIG. 4*a* shows a cut through the connecting device 10 of FIG. 3 along line A-A before the mounting plate 1, the connecting plate 2 and the coupling plate 3 were mutually displaced. This view shows the coupling flange 31, the second adjustment screw 23 (shown in sectional view) held by the coupling flange 31 as well as the window opening 35 in the coupling plate 3, into which the second connecting flange 22 extends. Further shown is the third adjustment screw 13, preferably a threaded bolt, which has been inserted into in the adjustment flange 15. Further, the wing element 16 is shown, which is partially separated by a cut 19 from the body 17 of the mounting plate 1 and which is connected to the body 17 of the mounting plate 1 via a bendable joint 190. Hence, by turning the third adjustment screw 13 the body 17 of the mounting plate 1 can be turned relative to the wing element 16.

FIG. 4*b* shows a cut through the connecting device 10 of FIG. 3 along line A-A with subsequent mutual displacement of the mounting plate 1, the connecting plate 2 and the coupling plate 3. The mounting plate 1 and the connecting plate 2 have been shifted horizontally against one another. The coupling plate 3 however has been shifted vertically downwards relative to the connecting plate 2.

Figure 5B:
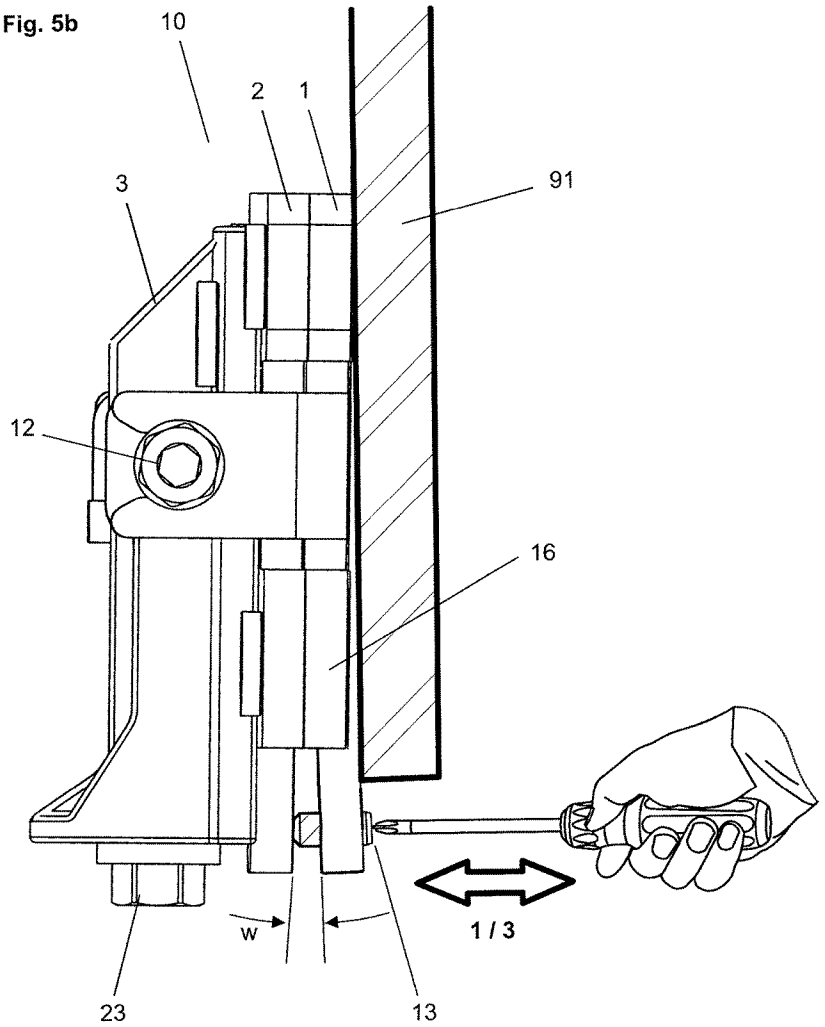
FIG. 5*b* the connecting device 10 of FIG. 5*a* during adjustment for setting the inclination of the coupling plate 3 relative to the mounting plate 1 and the sliding door 91.
Figure 5A:
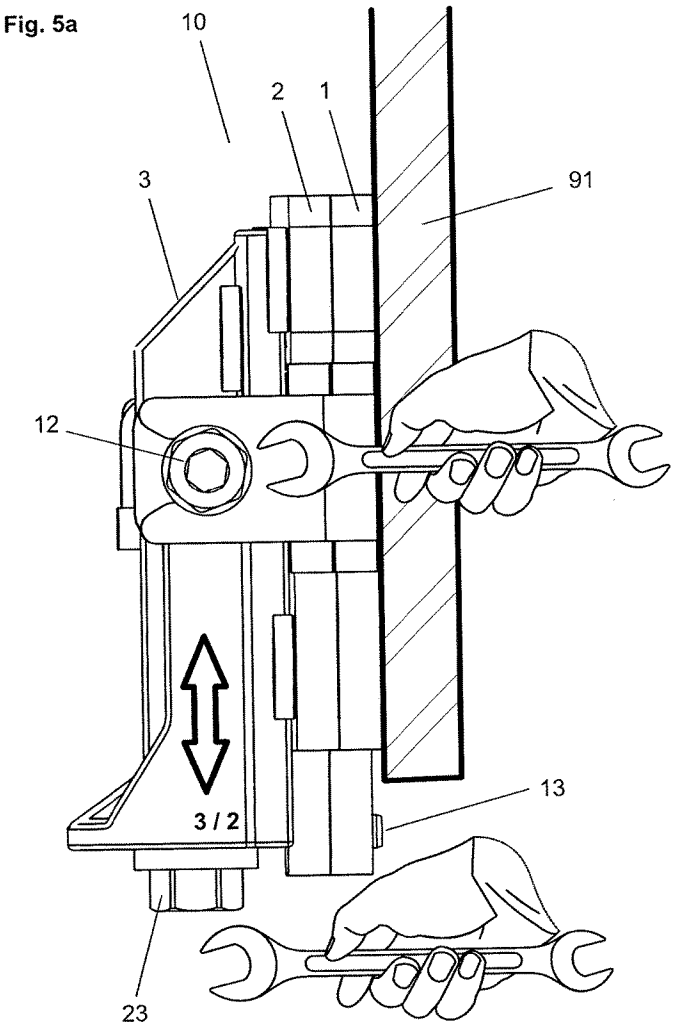
FIG. 5*a* the connecting device 10 of FIG. 3 seen from the side during the adjustment for the mutual horizontal displacement of the mounting plate 1 and the connecting plate 2 as well as for the mutual vertical displacement of the coupling plate 3 and the connecting plate 2.

FIG. 5*a* shows the connecting device 10 of FIG. 3 from the side during the adjustment for a horizontal mutual displacement of the mounting plate 1 and the connecting plate 2 by turning the first adjustment screw 12 as well as for a mutual vertical displacement of the coupling plate 3 and the connecting plate 2 by turning the second adjustment screw 23.

FIG. 5*b* shows the connecting device 10 of FIG. 5*a* during the adjustment for setting the inclination of the coupling plate 3 relative to the mounting plate 1 by turning the third adjustment screw 13 provided in the embodiment of a threaded bolt, which is inserted into the mounting plate 1. By turning the third adjustment screw 13 the inclination of the door blade of the first sliding door 91 can be adjusted within an angle range w.

It is shown that the second and the third adjustment screw 23 and 13 are easily accessible below the wardrobe door 91. The first adjustment screw 12 however is easily accessible from the side so that all adjustment work can quickly, precisely and conveniently be executed.

Figure 6A:
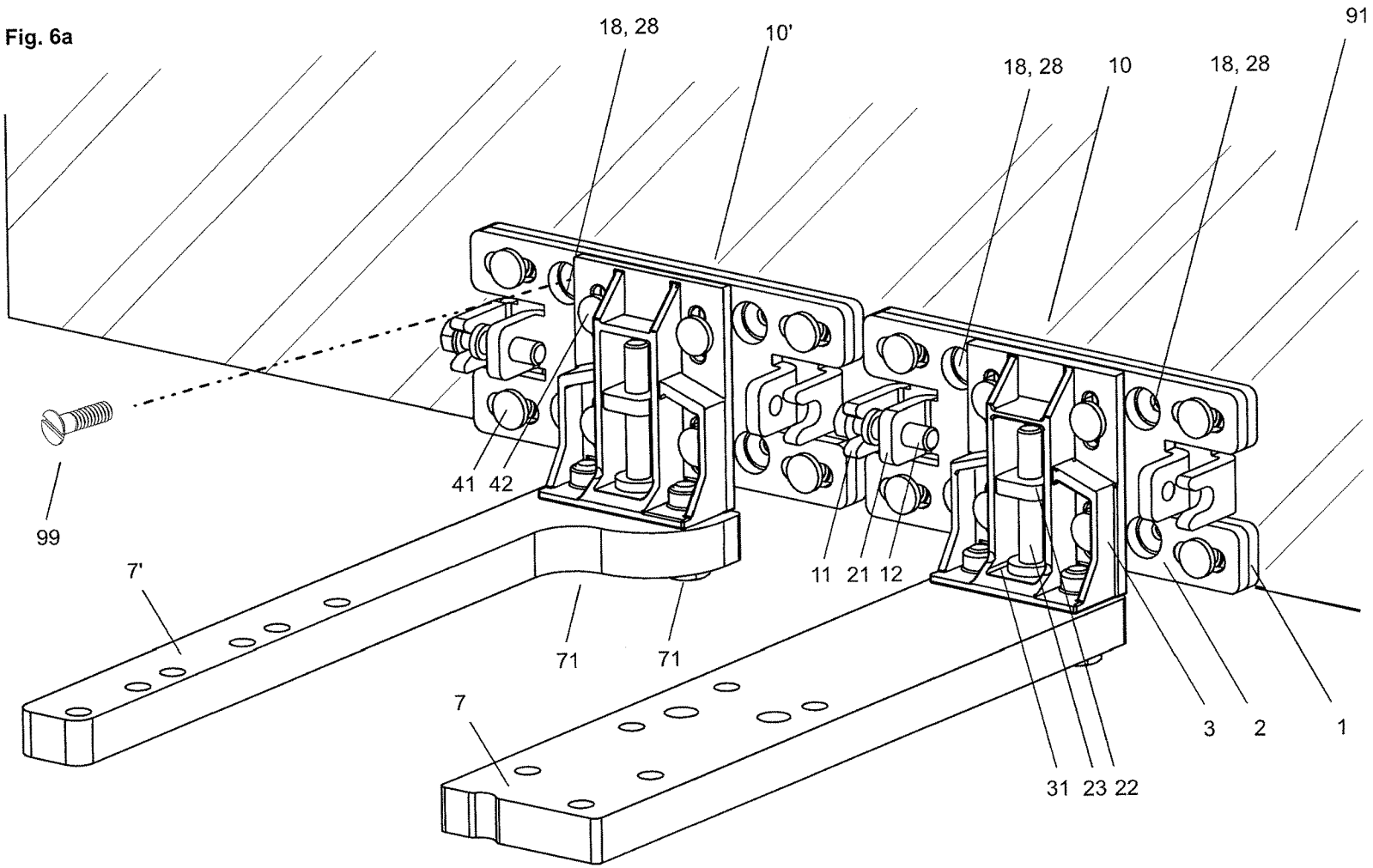
FIG. 6*a* both connecting devices 10, 10' of FIG. 1*b*, which are connected on the one side to the first sliding door 91 and on the other side each to a carriage lever 7, 7' of a carriage device.

FIG. 6*a* shows both connecting devices 10, 10' of FIG. 1*b*, which are connected on the one side by mounting screws 99 to the first sliding door 91 and on the other side by coupling screws 71 each to a carriage lever 7, 7' of a carriage device.

Figure 6B:
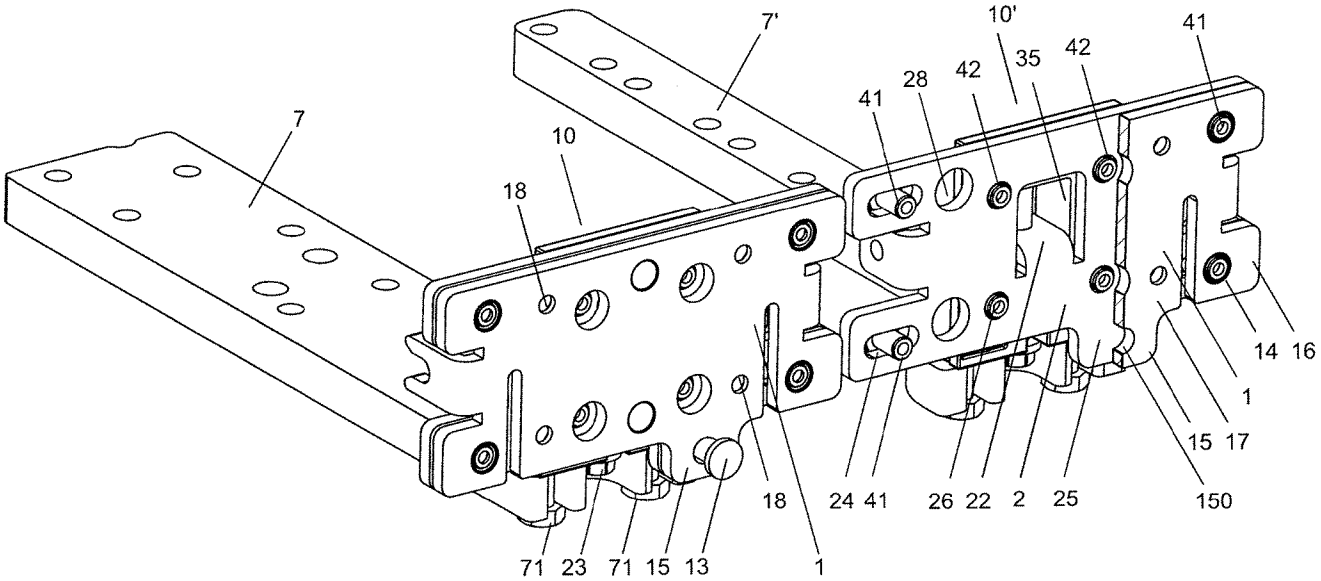
FIG. 6*b* the connecting devices 10, 10' of FIG. 6*a* without the sliding door 91 seen from the front side.

FIG. 6*b* shows the connecting devices 10, 10' of FIG. 6*a* without the sliding door 91 with a cut through the mounting plate 1 of connecting device 10' along line BB shown in FIG. 2. By cutting the mounting plate 1 the connecting plate 2 is partly visible. It is shown that the first connecting screws or rivets 41 are guided through the longitudinal slots 24. It is further shown that the second connecting screws or rivets 42 are held in receiving openings, e.g. threaded bores 26. It is further shown that the second connecting flange 22 is extending into the window opening 35 provided in the coupling plate 3. It is further shown that the third adjustment screw (not shown on the connecting device on the right side) is turnable through the threaded bore 150 provided in the adjustment flange 15 against the stop member 25.

Figure 6C:
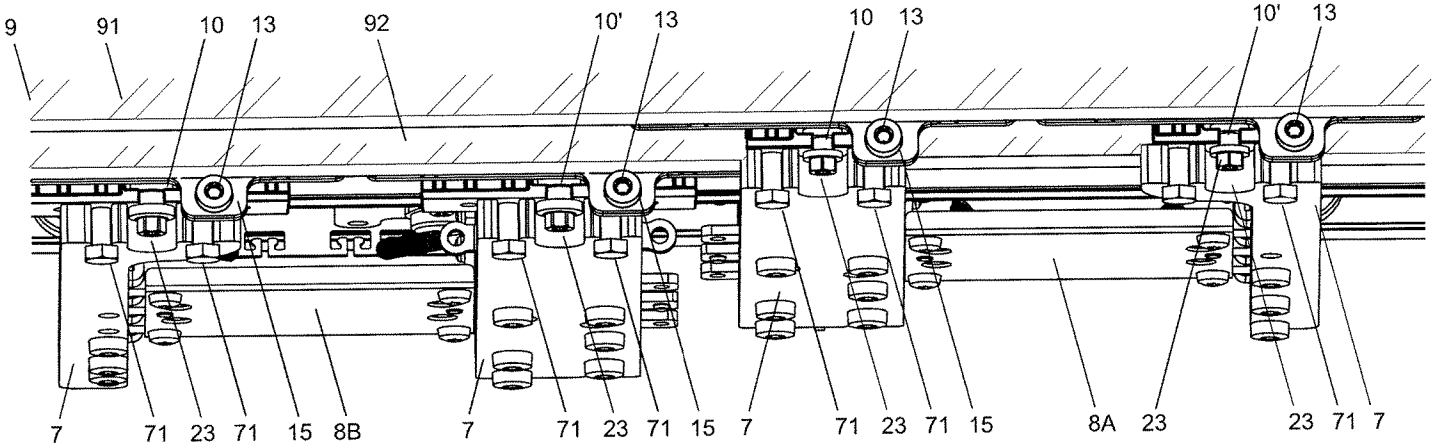
FIG. 6*c* the lower side of the wardrobe 9 of FIG. 1*a* seen from the front side with two carriages 8A, 8B, which are connected each via two carriage levers 7, 7' and related connecting devices 10, 10' to the corresponding sliding door 91, 92.

FIG. 6*c* shows the lower side of the wardrobe 9 of FIG. 1*a* from below with two carriages 8A, 8B, which are connected each via two carriage levers 7, 7' and related connecting devices 10, 10' with one of the sliding doors 91, 92. Of each of the connecting devices 10, 10' the second and the third adjustment screw 23, 13 are visible, which can easily be operated by means of a suitable tool.

LITERATURE

[1] U.S. Pat. No. 8,763,205B2
[2] U.S. Pat. No. 8,381,354B2

LIST OF REFERENCES

10 connecting device
1 mounting plate
11 mounting flange
111 first holding element, holding fork
12 first adjustment screw

121 screw collar at the first adjustment screw 12
13 third adjustment screw
14 threaded bores for the first connecting screws 41
15 adjustment flange
150 threaded bore for the third adjustment screw 13
16 wing elements
17 body of the mounting plate 11
18 mounting bores
19 cut
190 articulated joint, bending zone
2 connecting plate
21 first connecting flange
22 second connecting flange
23 second adjustment screw
231 screw collar at the second adjustment screw 23
24 longitudinal slots in the connecting plate 2
25 stop member
26 threaded bores for the second connecting screws 42
28 enlarged transfer opening
3 coupling plate
31 coupling flange
311 second holding element 311 at the coupling flange 31
34 longitudinal slots in the coupling plate 3
35 window opening in the coupling plate 3
39 stabilising ribs
41 first connecting elements, e.g. screws or rivets
42 second connecting elements, e.g. screws or rivets
6 complementary guide
7, 7' carriage lever
71 coupling screws
9 piece of furniture, particularly wardrobe
90 wardrobe opening
91,92 sliding doors
99 mounting screws
w adjustment angle

The invention claimed is:

1. A connecting device with a mounting plate, which is connectable to a sliding door with mounting screws and which is connectable to a carriage device, the connecting device comprising:

a connecting plate that is arranged between the mounting plate and a coupling plate, which is connectable to the carriage device, wherein:

the connecting plate is connected, shiftable in a first direction, to the mounting plate by first connecting elements and is held shiftable to a selected first shift position by a first adjustment screw that is connected to the mounting plate, the coupling plate is connected, shiftable in a second direction, to the connecting plate by second connecting elements and is held shiftable to a selected second shift position by a second adjustment screw that is connected to the connecting plate, the mounting plate comprises a mounting flange, and the connecting plate comprises a first connecting flange, the mounting flange or the first connecting flange comprises a threaded bore for receiving the first adjustment screw, and the first connecting flange or the mounting flange comprises a holding element for rotatably holding the first adjustment screw.

2. The connecting device according to claim 1, wherein:

the connecting plate is shiftable horizontally relative to the mounting plate, the coupling plate is shiftable vertically relative to the connecting plate, or the connecting plate is shiftable vertically relative to the mounting plate, and the coupling plate is shiftable horizontally relative to the connecting plate.

3. The connecting device according to claim 1, wherein the first connecting elements are flange elements, that are engaged into one another, or first connecting screws or rivets, which are held in first receiving openings provided in the mounting plate and in first longitudinal slots provided in the connecting plate.

4. The connecting device according to claim 3, wherein the first longitudinal slots provided in the connecting plate and second longitudinal slots provided in the coupling plate are aligned according to the first or second direction inclined or perpendicular to one another.

5. The connecting device according to claim 1, wherein the second connecting elements are flange elements that are engaged into one another, or second connecting screws, which are held in second receiving openings provided in the connecting plate and in second longitudinal slots provided in the coupling plate.

6. The connecting device according to claim 5, wherein first longitudinal slots provided in the connecting plate and the second longitudinal slots provided in the coupling plate are aligned according to the first or second direction inclined or perpendicular to one another.

7. The connecting device according to claim 1, wherein:

the connecting plate comprises a second connecting flange, the coupling plate comprises a coupling flange and a window opening, into which the second connecting flange extends, the coupling flange or the second connecting flange comprises a threaded bore for receiving the second adjustment screw, and the second connecting flange or the coupling flange comprises a second holding element for rotatably holding the second adjustment screw.

8. The connecting device according to claim 1, wherein a third adjustment screw is provided, with which the coupling plate or a part thereof is turnable relative to the mounting plate or with which the mounting plate or a part thereof is turnable relative to the coupling plate.

9. The connecting device according to claim 8, wherein the third adjustment screw is held in a threaded bore provided in an adjustment flange, which is provided at the mounting plate such, that the third adjustment screw is turnable against a stop member, which is provided at the connecting plate or at the coupling plate.

10. The connecting device according to claim 9, wherein the second and the third adjustment screws are arranged on the same side, on the upper side or the lower side of the connecting device.

11. The connecting device according to claim 9, wherein the mounting plate, the connecting plate, and/or the coupling plate except for the adjustment flange and the stop member each are formed symmetrically and are made of steel, sheet steel, or zinc die-casting.

12. The connecting device according to claim 9, wherein the mounting plate, or the connecting plate, or the coupling plate comprises an articulated joint, around which the mounting plate, or the coupling plate, or a part thereof is turnable when the third adjustment screw is actuated.

13. The connecting device according to claim 8, wherein the mounting plate, or the connecting plate, or the coupling plate comprises an articulated joint, around which the mounting plate, or the coupling plate, or a part thereof is turnable when the third adjustment screw is actuated.

14. The connecting device according to claim 13, wherein the articulated joint is a bendable joint that is adjoined by at least one cut.

15. The connecting device according to claim 13, wherein the second and the third adjustment screws are arranged on the same side, on the upper side or the lower side of the connecting device.

16. A piece of furniture comprising:

the connecting device according to claim 1, wherein the sliding door and the carriage device are connected to each other via the connecting device.

17. The piece of furniture according to claim 16, wherein the connecting device is arranged on the sliding door at the lower side or the upper side of the piece of furniture, so that at least the second and or a third adjustment screw is accessible below or above the sliding door.

* * * * *